US011318057B1

(12) United States Patent
Synkowski

(10) Patent No.: US 11,318,057 B1
(45) Date of Patent: May 3, 2022

(54) BED SIDE SUPPORT STRUCTURE

(71) Applicant: Edward Synkowski, Pittsburgh, PA (US)

(72) Inventor: Edward Synkowski, Pittsburgh, PA (US)

( * ) Notice: Subject to any disclaimer, the term of this patent is extended or adjusted under 35 U.S.C. 154(b) by 119 days.

(21) Appl. No.: 16/688,062

(22) Filed: Nov. 19, 2019

(51) Int. Cl.
*A61G 7/05* (2006.01)
*A47C 21/08* (2006.01)

(52) U.S. Cl.
CPC ..... *A61G 7/0516* (2016.11); *A61G 7/0519* (2016.11); *A61G 7/0522* (2016.11); *A47C 21/08* (2013.01)

(58) Field of Classification Search
CPC .... A47C 21/08; A61G 7/0516; A61G 7/0522; A61G 7/0519; A47D 9/00; A47D 9/005; A47D 9/02; A47D 9/04; A47D 7/00; A47D 7/002; A47D 7/005; A47D 7/007; A47D 7/01; A47D 7/02; A47D 7/03; A47D 7/04
See application file for complete search history.

(56) References Cited

U.S. PATENT DOCUMENTS 4,686,727 A 8/1987 Wilkinson
6,082,693 A * 7/2000 Benson ..... A61G 11/00 248/281.11
2002/0152550 A1* 10/2002 Tharalson ..... A47D 5/00 5/95
2004/0244113 A1* 12/2004 Wolfgang ..... A47D 7/03 5/509.1
2010/0199426 A1* 8/2010 Long ..... A47D 13/083 5/100
2017/0360216 A1* 12/2017 Sclare ..... A47D 9/02
2020/0367667 A1* 11/2020 Wynn ..... A47D 9/00

* cited by examiner

*Primary Examiner* — David R Hare
*Assistant Examiner* — Adam C Ortiz
(74) *Attorney, Agent, or Firm* — Sanchelima & Associates, P.A.; Christian Sanchelima; Jesus Sanchelima

(57) ABSTRACT

A bedside support structure including a support assembly and a base assembly is disclosed herein. The support assembly includes a cushioned portion and a support structure. The base assembly includes an outer base and an inner base portion. The inner base portion is adjustable from the outer base portion such that a user may configure the height of the bedside support structure. The base assembly further includes an elongated arm that is pivotably mounted to one end of the outer base. The other end of the elongated arm is pivotably mounted to the opposite end of the support structure. The pivot configuration allows a user to adjust the height of the support structure as needed to fit the height of the bed of an individual. The bedside support structure provides a structural support for users of limited mobility to aid the users in sitting beside a bed.

12 Claims, 3 Drawing Sheets

BED SIDE SUPPORT STRUCTURE

BACKGROUND OF THE INVENTION

1. Field of the Invention

The present invention relates to a bedside support structure and, more particularly, to a bedside support structure that may be placed at the side of a bed for aiding individuals with limited mobility. The present invention provides individuals of limited mobility a safer way of sitting on the edge or side of the bed that prevents falling forward. Additionally, the present invention adds comfort and eliminates the danger of falling thereby preventing injury and additional medical expenses.

2. Description of the Related Art

Several designs for a bedside support structure have been designed in the past. None of them, however, include a bed attachment for assisting elderly people with sitting up in bed. The attachment may be a rigid frame having a right vertical support, a left vertical support, and a horizontal support bar connecting the left and right vertical supports. The attachment goes over the top of a bed and straddles a user. The user may reach up and grasp the horizontal support bar to left themselves up and prevent themselves from falling out of bed. The entire device may be laminated with cushioning. It is known that individuals of limited mobility such as elderly people or people with certain disabilities often have a hard time in getting out of bed. It is also known that individuals of limited mobility often suffer substantial injuries if they do not correctly get out of bed. This may cause irreputable damage to the health of the individual and may give the individual an increase in medical bills that they may not be able to afford. Therefore, there is need for a bedside support structure to aid users of limited mobility from falling out of bed. The present invention further aids a user in sitting comfortably on a bedside to achieve a comfortable position to read a book. The present invention would be helpful for patients with congestive heart failure or breathing difficulties to site at the edge of the bed without danger of falling.

Applicant believes that a related reference corresponds to U.S. Pat. No. 4,686,727 issued for A convenience bar assembly for a hospital bed includes a generally U-shaped member including two arms adapted for generally vertical orientation and a horizontal cross-member connecting the arms. The lowermost ends of the arms of the U-shaped member are attached to opposite sides of a bed so that the horizontal member is oriented over the bed transversely. A horizontal support bar is swingably connected to the horizontal cross-member so that the horizontal support bar hangs below the horizontal cross member when the horizontal support bar is at rest. However, it differs from the present invention because the U.S. Pat. No. 4,686,727 reference fails to provide a support structure disposed on the side of a bed to aid a user of limited mobility from falling out of bed. Furthermore, the present invention aids patients with congestive heart failure or breathing difficulties to sit at the edge of a bed without danger of falling. Additionally, the reference comprises a complicated configuration that is not easy to configure to an individual's bed side. The present invention addresses these issues by providing a bedside support structure that is easily configured to the side of a user's bed. Additionally, the present invention is easy to use and provides a user with maximum support in sitting beside a bed.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a bed-side support structure which provides a user with limited mobility the proper support needed to sit beside a bed.

It is another object of this invention to provide a bedside support structure to keep users of limited mobility from falling out of bed. Additionally, the bedside support structure aids patients with congestive heart failure or breathing difficulties in sitting at the edge of the bed without danger of falling.

It is still another object of the present invention to provide a bedside support structure having a simple and easy to manufacture configuration.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
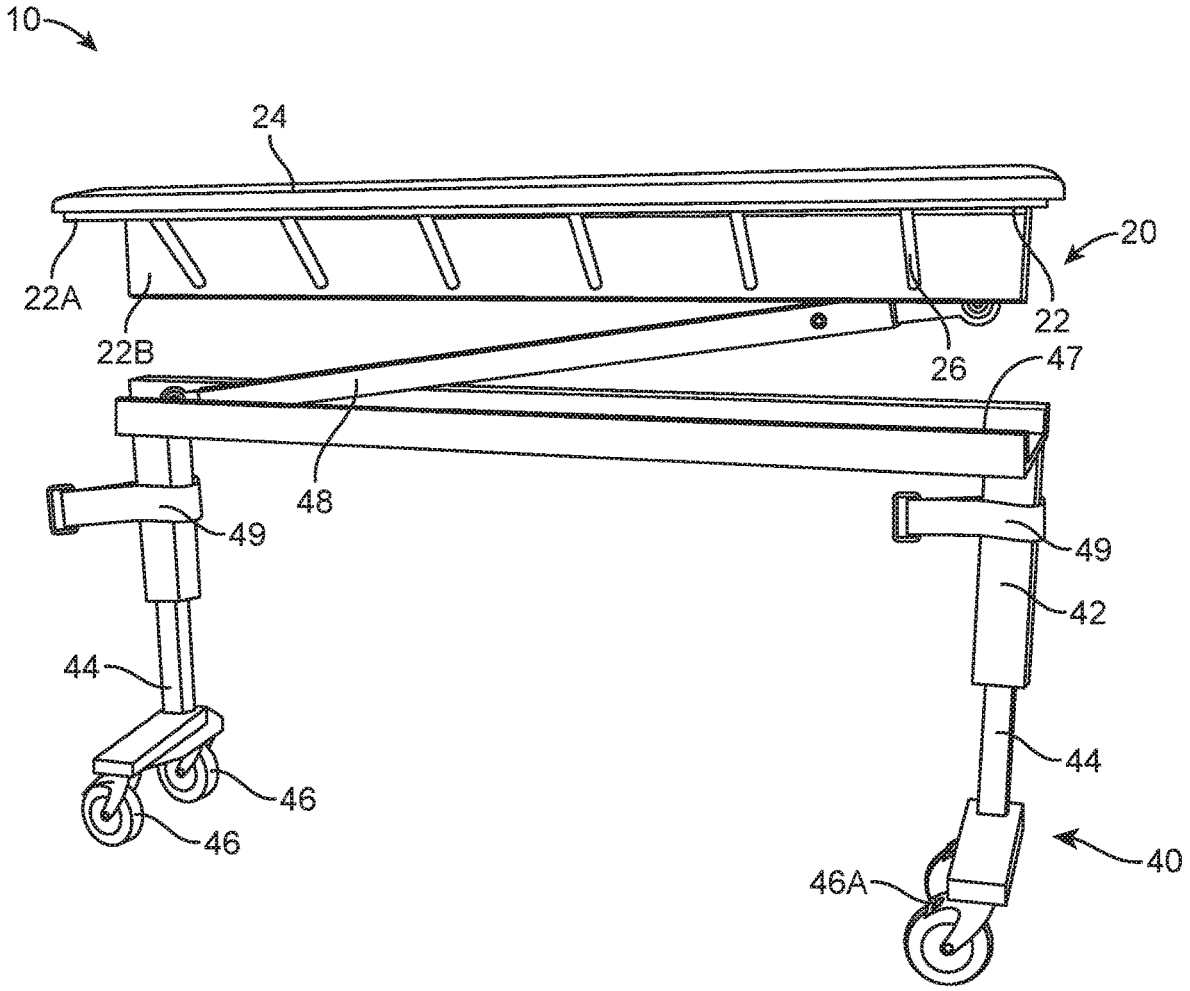
FIG. 1 represents an isometric view of a bedside support structure 10 wherein support assembly 20 and base assembly 40 may be observed in accordance to an embodiment of the present invention.
Figure 2:
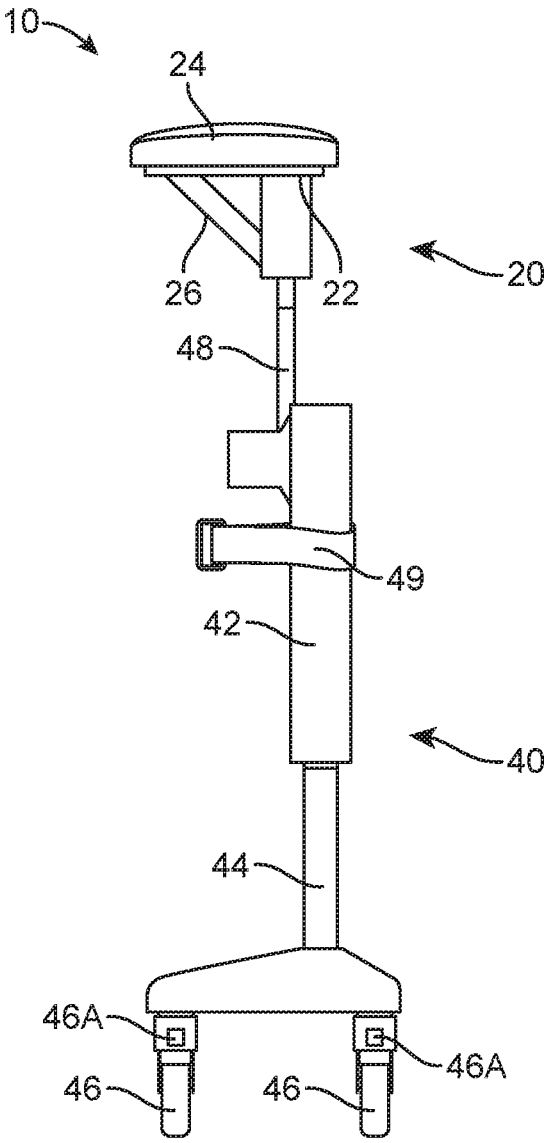
FIG. 2 shows a side view of a bedside support structure 10 having support assembly 20 and base assembly 40 in accordance to an embodiment of the present invention.
Figure 3:
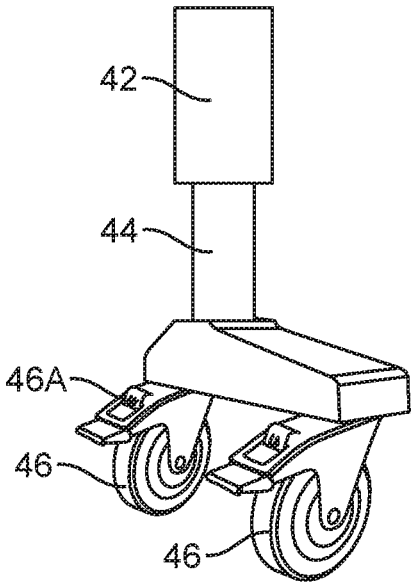
FIG. 3 illustrates an enlarged isometric view of wheels 46 of base assembly 40 in accordance to an embodiment of the present invention.
Figure 4:
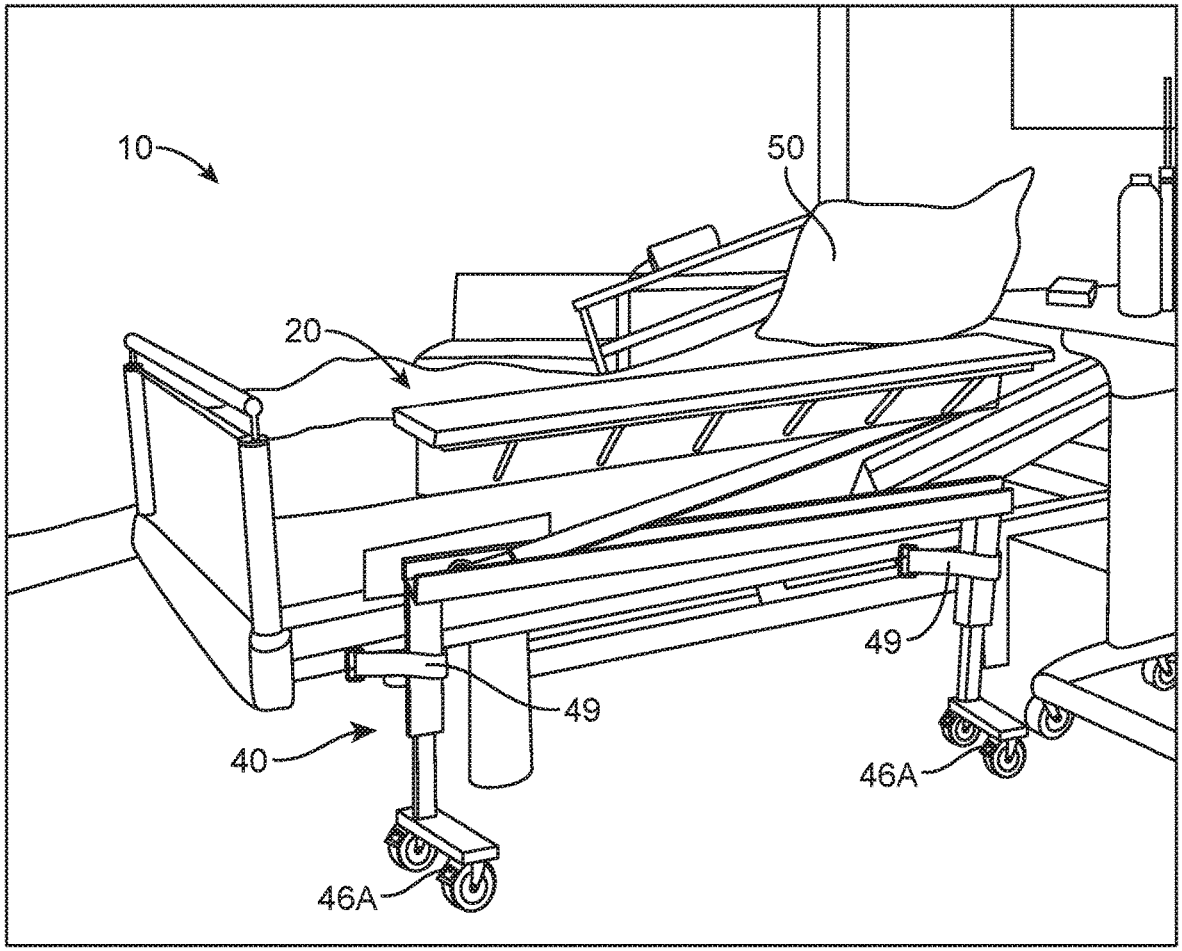
FIG. 4 is a representation of and isometric view of bedside support structure 10 being place on the side of a bed 50 in accordance to an embodiment of the present invention.

Referring now to the drawings, where the present invention is generally referred to with numeral 10, it can be observed a bedside support structure 10 that basically includes a support assembly 20 and a base assembly 40.

Support assembly 20 includes a support structure 22 having a first structure 22A and a second structure 22B. Support structure 22 may be made of a metallic material to provide the structure with the necessary support to withstand a user's pressure. It should be understood that support structure 22 may be made of any suitable material such as plastic, carbon fiber, and the like. First structure 22A and second structure 22B may be rectangular in shape. First structure 22A is disposed in a flat horizontal position having second structure 22B mounted underneath first structure 22A. Second structure 22B is disposed in a straight vertical position underneath first structure 22A. Second structure 22B may be mounted to first structure 22A using known mechanisms in the art such as welding, fasteners, and the like. Support assembly 22 further includes a cushioned portion 24 mounted to support structure 22. Cushioned portion 24 is mounted on top of first structure 22A thereon. Furthermore, cushioned portion 24 is of a shape that cooperates with that of first structure 22A. Cushioned portion 24 may be made of a cushioned foam material to provide a user with a comfortable supporting area when sitting beside a bed. It should be understood that any suitable material such as wool and the like may be used for cushioned portion 24 to provide a user with comfort. Support assembly 20 further includes support members 26. Support members may be made of any suitable metallic material. Support members 26 are mounted thereon first structure 22A and second structure 22B. Support members 26 is mounted thereon using known mechanisms in the art such as welding, fasteners, and the like. Additionally, support members 26 are mounted in a configuration such that support members 26 form a triangle shape with first structure 22A and second structure 22B. Support assembly 20 provides a user with the necessary support needed for applying the pressure needed to support a user in sitting beside a bed.

Base assembly 40 includes an outer base 42 and an inner base 44. Outer base 42 may comprises of an elongated straight bridge type shape having two supporting members at each end. Additionally, outer base 42 may be made of a metallic material to provide maximum support. However, it should be understood that outer base 42 may be made of any suitable material such as plastic, carbon fiber, and the like. Inner base 44 is provided therein outer base 42. Inner base 44 is disposed at each end of the supporting members of outer base 42. Inner base 44 may comprise of the same material as outer base 42. Additionally, inner base 44 includes wheels 46 having a locking mechanism 46A. Locking mechanism 46A allows a user to lock wheels 46A in a desired position to prevent base assembly 40 from moving in an unwanted direction. Furthermore, base assembly 40 includes inner channel 47 disposed on the top portion of outer base 42. Inner channel 47 is defined as a channel of empty space lined along the top portion of outer base 42. Base assembly 40 further includes an elongated arm 48 that is pivotably mounted to one end of inner channel 47. Elongated arm 48 may be made of any suitable material such as a metallic material. The other end of elongated arm 48 is pivotably mounted to the bottom portion of support structure 22. The pivot mounts of elongated arm 48 allow a user to adjust the distance in height from support assembly 20 being attached to base assembly 40. In the present embodiment, support assembly 20 is mounted thereon base assembly 40 having elongated arm pivotably connecting both assemblies. Bedside support structure 10 is then rolled up to the side of a user's bed 50. Another user may then lock bedside support structure 10 to the side of bed 50 using locking mechanism 46A. In one embodiment, base assembly 40 may further include fastening mechanisms 49 configured to be mounted to bed 50. Additionally, fastening mechanisms 49 may be rectangular hook and loop fastening straps that are configured to wrap around a support structure of bed 50. Support assembly 20 is then adjusted to the necessary height needed by a user of limited mobility lying in bed 50. Bedside support structure 10 provides the user of limited mobility the necessary support needed in sitting beside bed 50.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a bedside support structure, comprising:

a. a support assembly, including a support structure and a cushioned portion, said support structure including a first structure and a second structure, said first structure has an elongated rectangular shape, said first structure is entirely flat, said second structure has an elongated rectangular shape, said second structure is flat, said second structure having a bigger width than said first structure, said second structure is perpendicularly connected underneath a length of said first structure and on a first distal end of a width of said first structure, said support structure further including support members, each of said support members has a first support end connected to a second distal end of the width of said first structure, each of said support members has a second support end connected to a lower end of said second structure;

b. a base assembly, including at least two inner bases and at least two outer bases, said at least two inner bases having wheels mounted thereon, said at least two outer bases including an inner channel located between said at least two outer bases, said at least two outer bases slidably receiving said at least two inner bases, said base assembly further including an elongated arm wherein said elongated arm is pivotably mounted to one end of said inner channel; and c. a hospital bed.

2. The system for a bedside support structure of claim 1 wherein said support members are mounted to said first structure and said second structure at an angle such that a triangle shape is formed.

3. The system for a bedside support structure of claim 1 wherein said support structure is made of a metallic material.

4. The system for a bedside support structure of claim 1 wherein said elongated arm is pivotably mounted to one end of said second structure.

5. The system for a bedside support structure of claim 1 wherein said bedside support structure is placed on the side of said hospital bed.

6. The system for a bedside support structure of claim 1 wherein each inner base of said at least two inner bases is adjustable from one of said at least two outer bases such that the height of said bedside support structure may be adjusted to fit a user's need.

7. The system for a bedside support structure of claim 1 wherein said elongated arm being pivotably mounted to said second structure allows a user to configure the height of said support structure having said cushioned portion thereon.

8. The system for a bedside support structure of claim 1 wherein said cushioned portion is mounted on the top end of said first structure.

9. The system for a bedside support structure of claim 1 wherein said wheels includes a locking mechanism to lock said bedside support structure in place.

10. The system for a bedside support structure of claim 1 wherein said base assembly further includes fastening mechanisms configured to securely attach said base assembly to said hospital bed.

11. The system for a bedside support structure of claim 10 wherein said fastening mechanisms are a hook and loop fastening straps.

12. A system for a bedside support structure consisting of:

a. a support assembly, including a support structure and a cushioned portion, said support structure including a first structure and a second structure, said first structure has an elongated rectangular shape, said first structure is entirely flat, said second structure has an elongated rectangular shape, said second structure is flat, said second structure having a bigger width than said first structure, said second structure is perpendicularly connected underneath a length of said first structure and on a first distal end of a width of said first structure, said support structure further including support members, each of said support members has a first support end connected to a second distal end of the width of said first structure, each of said support members has a second support end connected to a lower end of said second structure, said cushion portion is located on a top portion of said first structure;

b. a base assembly, including at least two inner bases and at least two outer bases, each of said at least two outer bases has an elongated cuboid shape, each of said at least two inner bases has an elongated cuboid shape, said at least two inner bases having wheels mounted thereon, said at least two outer bases including an inner channel located between said at least two outer bases, said at least two outer bases slidably receiving said at least two inner bases, said base assembly further including an elongated arm wherein said elongated arm is pivotably mounted to one end of said inner channel, said elongated arm is pivotably mounted to said second structure; and c. a hospital bed, said bedside support structure is placed on the side of said hospital bed.

* * * * *